US009587344B2

(12) United States Patent
Kim

(10) Patent No.: US 9,587,344 B2
(45) Date of Patent: Mar. 7, 2017

(54) HORIZONTALLY VIBRATING LAUNDRY WASHER

(71) Applicant: Dongbu Daewoo Electronics Corporation, Seoul (KR)

(72) Inventor: Jeong Hyeon Kim, Anyang-si (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 348 days.

(21) Appl. No.: 14/185,025

(22) Filed: Feb. 20, 2014

(65) Prior Publication Data

US 2015/0176181 A1 Jun. 25, 2015

(30) Foreign Application Priority Data

Dec. 24, 2013 (KR) ..... 10-2013-0163093

(51) Int. Cl.

| | |
|---|---|
| ***D06F 1/04*** | (2006.01) |
| ***D06F 19/00*** | (2006.01) |
| ***D06F 27/00*** | (2006.01) |
| ***D06F 37/22*** | (2006.01) |
| ***D06F 37/30*** | (2006.01) |

(52) U.S. Cl.

CPC ..... *D06F 37/30* (2013.01); *D06F 27/00* (2013.01); *D06F 1/04* (2013.01); *D06F 19/00* (2013.01); *D06F 37/22* (2013.01)

(58) Field of Classification Search

CPC . D06F 1/04; D06F 19/00; D06F 27/00; D06F 37/22; D06F 37/30

USPC ..... 68/133, 153, 155

See application file for complete search history.

(56) References Cited

U.S. PATENT DOCUMENTS

| | | | | |
|---|---|---|---|---|
| 1,366,418 | A | 1/1921 | Remmert | |
| 1,447,017 | A | 2/1923 | Fleming | |
| 1,465,444 | A | 8/1923 | Koebel | |
| 2012/0006065 | A1* | 1/2012 | Jung | H02P 27/085 68/12.02 |

FOREIGN PATENT DOCUMENTS

| | | | |
|---|---|---|---|
| DE | 817745 | B | 10/1951 |
| JP | S55101584 | | 8/1980 |
| JP | 10277286 | A | 10/1998 |
| KR | 10-0171476 | | 5/1999 |
| KR | 200268655 | | 3/2002 |
| KR | 10-2001-0106379 | | 8/2005 |

OTHER PUBLICATIONS

Yamawaki, Kinsuke, "JP10277286A English Machine Translation.pdf", Oct. 20, 1998—Machine translation from J-PlatPat.*

The extended European Search Report dated Apr. 15, 2015, issued in corresponding European Patent Application No. 14177167.

* cited by examiner

*Primary Examiner* — Jason Ko
*Assistant Examiner* — Levon J Shahinian

(57) ABSTRACT

The present disclosure relates to a washing machine for washing laundry. According to exemplary embodiments of the present disclosure, the washing machine may use a novel horizontal vibration method of washing laundry and the like instead of a rotation method. The washing machine may include a moving magnet connected to the washing tub causing the washing tub to move horizontally. The moving magnet may be a permanent magnet or an electromagnet.

7 Claims, 3 Drawing Sheets

HORIZONTALLY VIBRATING LAUNDRY WASHER

CROSS-REFERENCE TO RELATED APPLICATIONS

This application is based on and claims priority from Korean Patent Application No. 10-2013-0163093, filed on Dec. 24, 2013 with the Korean Intellectual Property Office, the disclosure of which is incorporated herein in its entirety by reference.

TECHNICAL FIELD

The present disclosure relates to a washing machine for washing laundry (e.g., a washer). The washing machine, which is an apparatus that supplies water to wash clothes or the like, is widely used for home and industrial applications.

BACKGROUND

In general, a washing machine may be an upright type (e.g., a top-loading washing machine) or a drum type (e.g., front-loading) washing machine. An upright washing machine holds laundry and rotates while upright, and a drum type washing machine rotates along a horizontal axis.

Since the upright type washing machine generally has a structure in which laundry is inserted from the top, the upright type washing machine is referred to as a top loading type washing machine, and since the drum type washing machine generally has a structure in which laundry is inserted from the front side, the drum type washing machine is referred to as a front loading type washing machine.

The washing machine generally includes a tub that stores water and a rotatable drum inside the tub that holds the laundry.

In general, the tub is fixed inside the washing machine, and the drum is inside the tub and may rotate. The drum has a plurality of holes therein, and water stored in the tub flows into the holes and is discharged from the drum through the holes.

In a drum type washing machine of the related art, a motor is mounted behind and/or below the tub, and the drum inside the tub is connected to the motor by a rotatable shaft in the tub having a bearing at the interface with the tub.

The washing machine of the related art washes laundry while the drum rotates and may cause noise and vibration due to the rotation of the drum, which may be large and heavy. Further, where a load distribution inside the drum is unbalanced during rotation, the drum may vibrate hard in one direction due to centrifugal force, and the resulting noise and vibration may be severe.

Some laundry may become tangled with other laundry and be damaged when the drum rotates, and a user may need to untangle laundry after completion of the washing, which is inconvenient.

SUMMARY

The present disclosure has been made in an effort to provide a washing machine capable of washing laundry by horizontal movement and/or a rocking motion instead of rotation.

Exemplary embodiments of the present disclosure provide a washing machine capable of washing laundry using a horizontal and/or a rocking motion instead of a rotation method.

The washing machine has a washing tub configured to hold laundry. The washing tub may hold water with the laundry and may have only a single washing tub, without a separate drum.

Horizontal reciprocation and/or oscillation of the washing tub may be caused by a moving magnet configured so the magnet and the washing tub move together horizontally. The moving magnet may be a permanent magnet or an electromagnet.

The washing machine may include a horizontal guide that guides horizontal movement and/or oscillation of the moving magnet. The horizontal guide may support at least a part of the moving magnet, and may have a groove or slot extending in the direction of the horizontal movement of the moving magnet.

The moving magnet may be moved in the horizontal direction by magnetic force from an electromagnet which has a magnetic field.

The washing machine may include a controller for controlling a current supplied to the electromagnet, thereby controlling the oscillation of the moving magnet and/or causing a direction of the magnetic field of the electromagnet to change or reverse.

A compression plate and an actuator may be on an inner wall of the washing tub. One end of the actuator may be supported by an inner wall of the washing tub, and another end may be connected to the compression plate. The washing tub may have a plurality of compression plates and actuators.

The laundry inside the washing tub is compressed by the compression plate, and thus, the water in the laundry may be forcibly discharged (e.g., squeezed) from the laundry.

The controller of the washing machine may be configured or programmed to cause the washing machine to perform a laundry washing cycle, including a washing cycle, a rinsing cycle, and a drying cycle, and the compression plate may be configured to be used in the washing cycle, the rinsing cycle, and the drying cycle.

In the related art washing machine having a drum that rotates, the drum rotates at a high speed for the spin-drying, and the laundry may be damaged by the centrifugal force of the rotating drum, but the exemplary washing machine according to embodiments of the present disclosure uses the compression plate so that damage to the laundry is prevented or reduced. When the washing machine in the related art performs spin-drying where a load of the laundry inside the drum is not evenly distributed in the drum, noise and vibrations may be produced. The washing machine according to embodiments of the present disclosure uses the compression plate to dry the laundry and noise and vibration may be greatly reduced compared to the rotation method.

A hydraulic cylinder (e.g., an actuator) may be used to move the compression plates together and apart.

A washboard or other undulating surface having a plurality of protrusions and depressions or toughs may be inside and/or on a bottom surface of the washing tub. Contact and friction between the laundry and the inner wall of the washing tub may be increased by the plurality of protrusions on the bottom of the tub, improving the washing function of the washing machine.

A damper that dampens a vertical movement of the washing tub may be installed between the washing tub and the moving magnet. When the moving magnet horizontally reciprocates and/or oscillates, inertia may cause the laundry inside the washing tub may collect or agglomerate at one side in the washing tub. This may cause one side of the washing tub to move vertically. The vertical movement of the washing tub may cause a vertical movement of the laundry inside the washing tub, thereby further improving the effect of washing.

The moving magnet may have a contact member that contacts a lower surface of the washing tub, and sides of the moving magnet may be at an inclined/downward angle relative to the horizontal direction of the contact member. The damper may be on the inclined surfaces (e.g., the left and right sides) of the contact member of the moving magnet. Where the contact member is at the center of the moving magnet, the center part contacts a lower surface of the washing tub, and the washing tub may be arranged horizontally and may rotate.

In another exemplary embodiment of the present disclosure, a washing machine may have a slider that reciprocates and/or oscillates in a horizontal direction together with a washing tub, and a driver configured to provide a driving force that causes horizontal reciprocation and/or oscillation of the slider by applying power/current to an electromagnet.

The driver may have any form that is capable of electronically causing the slider to horizontally reciprocate/oscillate. For example, the driver may use a motor and/or a cam, or a hydraulic cylinder (e.g., an actuator). Related art mechanisms for making an object reciprocate in a horizontal direction may be applied to the slider and/or the driver in the present disclosure.

According to some embodiments of the present disclosure, a new type of washing machine is described that is different from the related art washing machine in several ways.

A new type of washing machine washes laundry using an oscillating and/or reciprocating movement, thereby preventing and/or reducing noise, vibration, and damage to the laundry.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Exemplary embodiments of the present disclosure will be described with reference to FIGS. 1 to 3.

Figure 1:
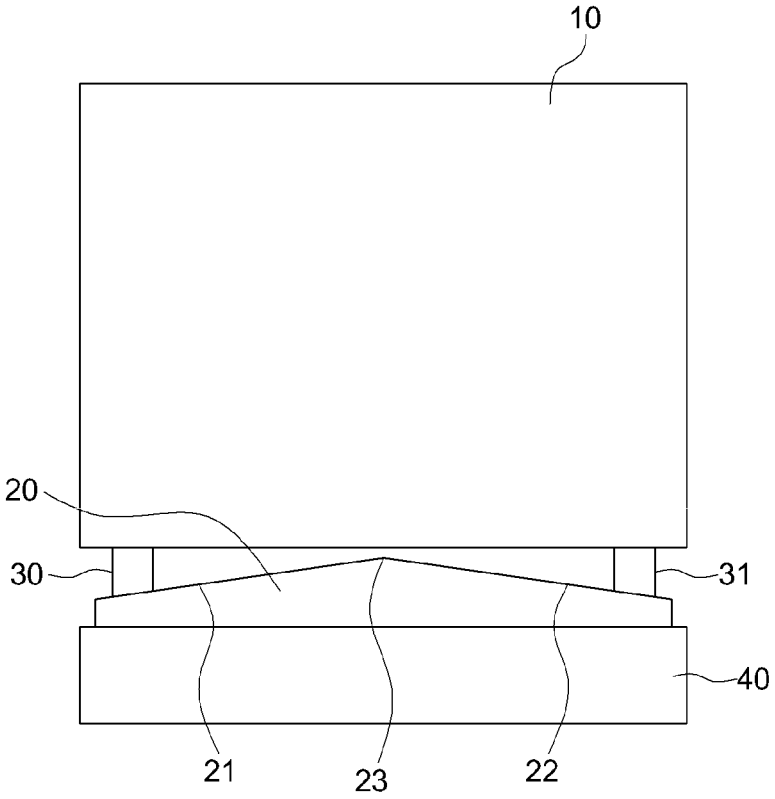
FIG. 1 is a view illustrating a front side of an exemplary washing machine according to exemplary embodiments of the present disclosure.
Figure 2:
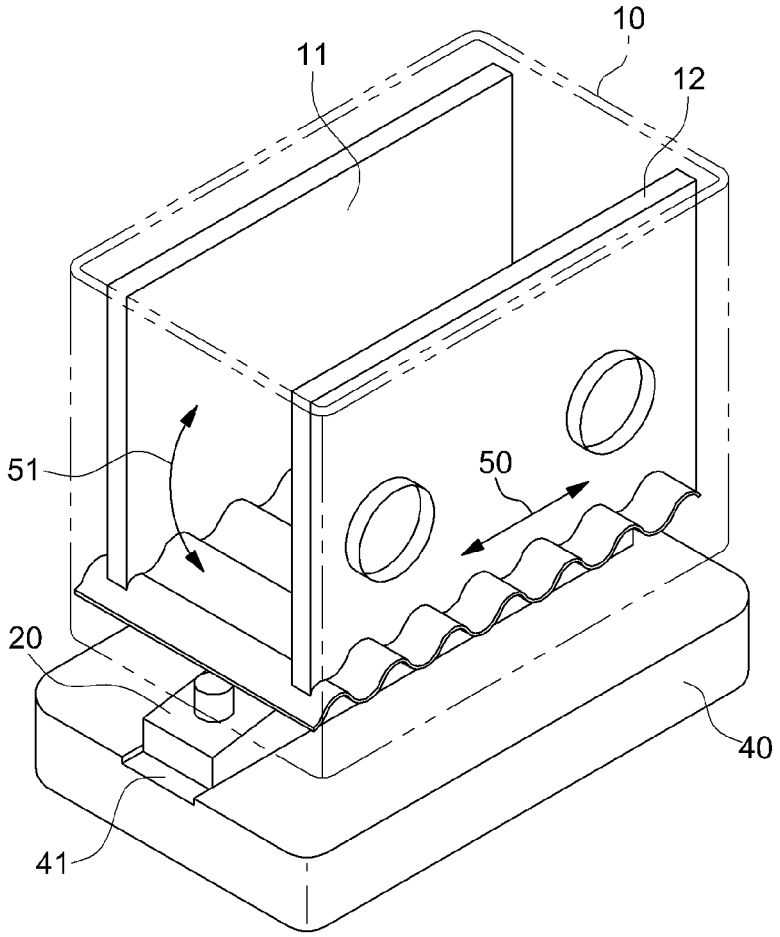
FIG. 2 is a perspective view illustrating an exemplary washing machine, as illustrated in FIG. 1.

First, the washing machine of FIG. 1 includes a washing tub 10 configured to hold laundry and water.

The washing tub 10 may have a quadrangular, 6-sided, or box shape, but may also have other various shapes. In the present exemplary embodiments, the washing tub 10 has a box shape that is elongated in one or two directions. That is, in the present exemplary embodiments, a cross-section of the washing tub 10 has a rectangular or square shape.

Figure 3:
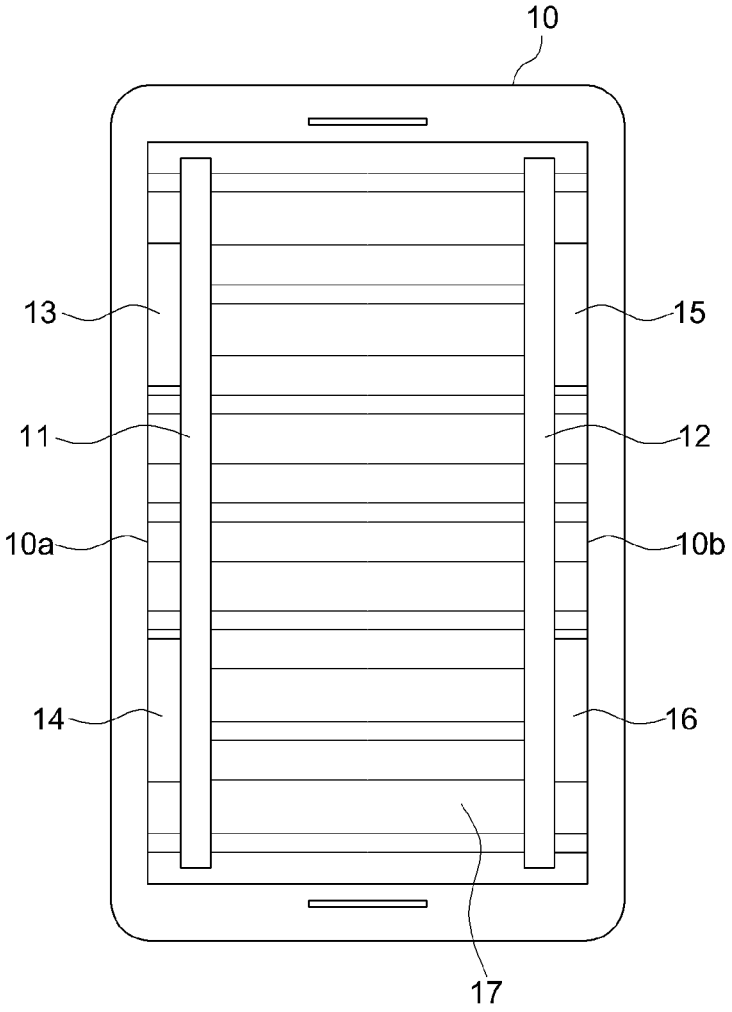
FIG. 3 is a view illustrating the inside of an exemplary washing tub, suitable for use in the washing machine of FIG. 1.

As illustrated in FIG. 3, a first compression plate 11 and a second compression plate 12 are inside the washing tub 10. The first compression plate 11 may be on, near, or adjacent to a first inner wall 10*a* of the washing tub 10 and has a first hydraulic cylinder 13 and a second hydraulic cylinder 14. The second compression plate 12 is on, near, or adjacent to a second inner wall 10*b* of the washing tub 10 and has a third hydraulic cylinder 15 and a fourth hydraulic cylinder 16. According to some embodiments, the washing machine may have other numbers of cylinders (e.g., 1, 3, etc.) compressing and retracting each of the compression plates 11 and 12.

The first compression plate 11 may be pressed toward the second inner wall 10*b* of the washing tub 10 by the first hydraulic cylinder 13 and the second hydraulic cylinder 14, and the second compression plate 12 may be pressed toward the first inner wall 10*a* of the washing tub 10 by the third hydraulic cylinder 15 and the fourth cylinder 16.

The laundry may be compressed between the first compression plate 11 and the second compression plate 12 so that water in the laundry may be forcibly discharged from the laundry.

The first compression plate 11 and the second compression plate 12 may be used in a washing cycle and a rinsing cycle, as well as a drying cycle.

The first compression plate 11 and the second compression plate 12 may be used to move the laundry in a horizontal and/or vertical direction as the washing tub 10 reciprocates or oscillates. That is, when the washing tub 10 oscillates, the first compression plate 11 and/or the second compression plate 12 may cause the laundry inside the washing tub 10 to move in a horizontal direction orthogonal to that of the tub 10, and/or move vertically above or away from the floor or bottom of the washing tub 10 while the first compression plate 11 and/or the second compression plate 12 reciprocate or oscillate (e.g., come together and move apart) in the horizontal direction opposite to that of the reciprocation or oscillation of the washing tub 10. The laundry may be washed while moved in a multi-axis direction by the first compression plate 11 and/or the second compression plate 12, improving the effect of washing. According to some embodiments, only one plate at a time oscillates or reciprocates.

In the present exemplary embodiments, the first compression plate 11 and the second compression plate 12 may be on the inner walls 10*a* and 10*b* of along the longest dimension of the washing tub 10.

A washboard or undulating surface having a plurality of protrusions 17 is on a bottom surface of the washing tub 10. The washboard may improve the washing effect by applying friction to the laundry and/or causing local eddies or currents within the tub 10.

In some exemplary embodiments, the protrusions 17 may have a shape elongated in a direction of the shortest dimension of the washing tub 10, and have recessions between the protrusions 17 in a same direction or along the longest dimension of the washing tub 10. The washing tub 10 may horizontally reciprocates/oscillate in the direction of the longest dimension of the tub 10.

A bottom surface of the washing tub 10 may be connected to a first damper 30 and a second damper 31. The first damper 30 and the second damper 31 may dampen vertical movement and/or vibration of the washing tub 10.

A lower end of each of the first damper 30 and the second damper 31 may be connected with a moving magnet 20. The horizontal reciprocation and/or oscillation of the moving magnet 20 may cause one side of the washing tub 10 to move vertically due to agglomeration of the laundry and the water inside the washing tub 10. Therefore, ends of the washing tub 10 may move vertically as well as horizontally, according to some embodiments of the present disclosure.

Where the lower surfaces of the washing tub 10 and the moving magnet 20 may be spaced apart, and the washing tub 10 may move in a vertical direction.

In one or more exemplary embodiments, a contact member 23 may be at a center portion of the moving magnet 20, in contact with a lower surface of the washing tub 10, and side surfaces of the moving magnet 20 have a first inclined surface 21 and a second inclined surface 22, which incline or decline vertically, based on the shape and location of contact member 23. Accordingly, the washing tub 10 may not move in the vertical direction, but reciprocates or oscillates based on the shape and location of contact member 23. In other words, the ends of the washing tub 10 may oscillate in a vertical direction, like a seesaw, where the contact member 23 contacts the washing tub 10, similar to the fulcrum or pivot point of the seesaw.

The horizontal movement of moving magnet 20 may be guided by a guide groove or slot 41 in a base 40. An electromagnet (not illustrated) may be installed on and/or inside the base 40. The electromagnet has or creates a magnetic field to apply magnetic force to the moving magnet 20, and the force may be controlled by adjusting the power and/or current applied to the electromagnet. The direction of the magnetic field may be controlled and/or switched so that the moving magnet 20 horizontally reciprocates or oscillates by switching of the direction of the magnetic field at a predetermined frequency.

A controller configured to control and supply power and/or current to the electromagnet is inside the base 40. The controller may be configured to cause the washing machine to perform a washing cycle, a rinsing cycle, and a drying cycle, and the electromagnet, the hydraulic cylinder, and the like, which may be controlled according to a program in the controller.

Exemplary embodiments of the present invention have been described, but terms and expressions used in the description of the exemplary embodiments are only used for illustrating the exemplary embodiments, and shall not be used to limit contents or the scope of the terms and the expression described in the claims of the present specification.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A washing machine, comprising:

a washing tub that holds laundry;

a moving magnet connected to or with the washing tub that horizontally reciprocates and/or oscillates together with the washing tub;

a horizontal guide that supports the moving magnet and guides the moving magnet; an electromagnet having a magnetic field configured to horizontally move the moving magnet by magnetic force;

a controller configured to control a current supplied to the electromagnet, causing the magnetic field of the electromagnet to switch direction, which causes the moving magnet to horizontally reciprocate and/or oscillate; and at least one damper between the washing tub and the moving magnet configured to dampen vertical movement and/or vibration of the washing tub and support the washing tub and/or the moving magnet, wherein the moving magnet has a contact member that contacts a lower surface of the washing tub and configured to support a pivot point to the washing tub, and both sides of the contact member are inclined in a direction away from the lower surface of the washing tub.

2. The washing machine of claim 1, further comprising:

a first compression plate inside the washing tub; and a first actuator having one end on or supported by a first inner wall of the washing tub and another end connected to the first compression plate, and configured to push and/or pull the first compression plate toward a second inner wall opposite to the first inner wall.

3. The washing machine of claim 2, further comprising:

a second compression plate in the washing tub between the first compression plate and the second inner wall; and a second actuator having one end on or supported by the second inner wall of the washing tub and another end connected to the second compression plate, and configured to push and/or pull the second compression plate toward the first inner wall.

4. The washing machine of claim 3, wherein each of the first actuator and the second actuator comprise at least one hydraulic cylinder.

5. The washing machine of claim 1, further comprising an undulating surface comprising a plurality of protrusions on a bottom surface inside the washing tub.

6. The washing machine of claim 1, wherein the washing tub holds water together with the laundry.

7. The washing machine of claim 1, wherein the washing tub has a quadrangular, 6-sided, or box shape.

* * * * *